US009475683B2

(12) United States Patent
Givens et al.

(10) Patent No.: US 9,475,683 B2
(45) Date of Patent: Oct. 25, 2016

(54) SYSTEMS AND METHODS FOR AUTOMATIC MIXED DRINK DISPENSING

(71) Applicant: Monsieur LLC, Atlanta, GA (US)

(72) Inventors: Barry Givens, Atlanta, GA (US); Eric Joseph Williams, Jr., Atlanta, GA (US)

(73) Assignee: MONSIEUR, INC., Dover, DE (US)

( * ) Notice: Subject to any disclaimer, the term of this patent is extended or adjusted under 35 U.S.C. 154(b) by 399 days.

(21) Appl. No.: 14/025,808

(22) Filed: Sep. 12, 2013

(65) Prior Publication Data

US 2014/0114469 A1 Apr. 24, 2014

Related U.S. Application Data

(60) Provisional application No. 61/700,312, filed on Sep. 12, 2012.

(51) Int. Cl.

| | |
|---|---|
| ***B67D 1/00*** | (2006.01) |
| *B67D 1/16* | (2006.01) |
| *B67D 1/08* | (2006.01) |
| *B67D 1/10* | (2006.01) |

(52) U.S. Cl.

CPC ..... *B67D 1/0041* (2013.01); *B67D 1/0888* (2013.01); *B67D 1/108* (2013.01); *B67D 1/16* (2013.01); *B67D 2001/082* (2013.01); *B67D 2210/00083* (2013.01); *B67D 2210/00089* (2013.01)

(58) Field of Classification Search

CPC B67D 1/0035; B67D 1/0041; B67D 1/0888; B67D 1/10

USPC ..... 141/100–105; 222/129.1–129.3, 132

See application file for complete search history.

(56) References Cited

U.S. PATENT DOCUMENTS

| | | | | |
|---|---|---|---|---|
| 3,940,019 | A * | 2/1976 | Kross | B67D 1/0041 222/108 |
| 5,960,997 | A | 10/1999 | Forsythe | |
| 6,711,465 | B2 * | 3/2004 | Tomassi | G07F 9/026 700/236 |
| 7,043,929 | B2 * | 5/2006 | Wang | B67D 3/0009 222/146.6 |
| 7,878,370 | B2 * | 2/2011 | Sevcik | B67D 1/0021 222/1 |
| 8,028,866 | B2 * | 10/2011 | Martin | B67D 3/0003 222/145.1 |
| 8,584,900 | B2 * | 11/2013 | Metropulos | B67D 1/0888 222/129.1 |
| 8,746,507 | B2 * | 6/2014 | Metropulos | B67D 1/0888 222/129.1 |
| 9,014,846 | B2 * | 4/2015 | Newman | B67D 1/0021 700/233 |

(Continued)

FOREIGN PATENT DOCUMENTS

| | | |
|---|---|---|
| WO | PCT/US2010/043058 | 1/2011 |
| WO | WO2011011690 A1 | 1/2011 |

OTHER PUBLICATIONS

U.S. Appl. No. 12/842,405, filed Jan. 27, 2011, Wayne Alpert et al.

(Continued)

*Primary Examiner* — Timothy L Maust

(74) *Attorney, Agent, or Firm* — Finnegan, Henderson, Farabow, Garrett & Dunner, LLP

(57) ABSTRACT

A drink dispensing device has refillable sealed containers having ingredients known to a processor. Where the processor can initiate commands to mix and dispense the ingredients based on a selections by a consumer. The drink dispensing device may also retrieve suggested drinks from a remote server for display to a consumer. The suggested drinks may be based on historical data stored in the drink dispensing device.

15 Claims, 6 Drawing Sheets

(56) References Cited

U.S. PATENT DOCUMENTS

| | | | | |
|---|---|---|---|---|
| 9,051,162 | B2 * | 6/2015 | Peters | B67D 1/0041 |
| 9,199,833 | B2 * | 12/2015 | Scarvelli | B67D 3/0032 |
| 2009/0008407 | A1 | 1/2009 | Sevcik | |
| 2015/0344284 | A1 * | 12/2015 | Perkins | B67D 1/0036 222/1 |

OTHER PUBLICATIONS

U.S. Appl. No. 11/663,018, filed Feb. 1, 2011, E. Scott Sevcik.
U.S. Appl. No. 11/442,214, filed Nov. 30, 2006, Kevin Baker.
U.S. Appl. No. 12/142,532, filed Oct. 4, 2011, Gary Martin.
U.S. Appl. No. 10/806,403, filed May 16, 2006, I-Feng Wang.

* cited by examiner

SYSTEMS AND METHODS FOR AUTOMATIC MIXED DRINK DISPENSING

CROSS-REFERENCE TO RELATED APPLICATIONS

This application claims priority to Provisional U.S. Patent Application Ser. No. 61/700,312, filed Sep. 12, 2012, and titled "Method and Apparatus for Mixing and Distributing Alcoholic Beverages," which application in its entirety is incorporated by reference herein.

FIELD OF INVENTION

This invention relates to an automatic drink dispensing system. More specifically, this invention relates to a portable automatic drink dispensing system having a drink suggestion engine.

BACKGROUND OF INVENTION

At social gatherings patrons desire drinks. Usually, preparation and distribution of the drinks is accomplished by a bartender mixing and serving the drinks. Depending on the scenario, the process of obtaining the drink can be frustrating for the patron for several reasons. First, the drink area may be too busy or lightly staffed, making it difficult to order and obtain the drink. Second, the bartender may be slow, or unfamiliar with the type of drink the patron desires. Finally, the bartender could measure the quantities of ingredients incorrectly. The owner of the establishment can also become frustrated if the particular bartender is poorly trained and wastes the drinks, or works at a slower pace because this directly affects profit margins. If the event is hosted at a private location like a home or professional meeting space, those issues can be more compounded. The host must determine what the guests will drink, how to transport the drinks to the location, locate a serving area, and find someone to serve the patrons and refresh supplies as they become diminished. If the drinks run low, someone must restock the items, make sure they are chilled, and provide the accompanying products for which to serve them.

Beyond the obvious frustrations of anticipating the needs and wants of the patrons, finding the space to place the serving area, and securing a party to serve, restock, and refill products, there is also the concern associated with paying for drinks with a risky waitress or bartender. Today, identity theft is rampant. Too often patrons have their credit card numbers stolen or lost.

There are also issues at social gatherings regarding the accidental serving of alcoholic drinks to minors. At private events, such as weddings or parties, having inexperienced or unconcerned bartenders, and thus allowing everyone at the party to enjoy drinks without verifying the age of the patron, a minor can easily be mistakenly served.

Ideally, patrons of any of the above mentioned scenarios could benefit from having a system where they could order their own drink and pay for it without having to stand in a line. Bar owners or party hosts can also benefit from a system that they could set up and leave to dispense multiple types of drinks for extended periods, without human mistake or interaction.

Further, due to the advent of social media and sharing, people may desire to share information with each other regarding the types of drinks they are ordering.

For the foregoing reasons, there is a need for a portable device, capable for mixing and dispensing a variety of drinks without the need for human intervention. This device would ideally communicate wirelessly, with a computer/phone application or server to utilize intelligent logic to suggest drinks, among other benefits that will be apparent from the detailed description below.

SUMMARY OF INVENTION

This summary is provided to introduce a selection of concepts in a simplified form that are further described below in the Detailed Description. This Summary is not intended to identify key features or essential features of the invention.

A portable drink dispenser for preparing and dispensing drinks having a housing containing one or more refillable containers is provided, wherein the drink selection may be based on a single ingredient or mixture of ingredients contained in the container(s). The drink dispenser is capable of mixing multiple ingredients from the containers, using pumps attached to each container for dispensing the drink as requested by the consumer.

The dispenser also contains a means for programming a processor to associate each pump with a particular ingredient to be mixed with other ingredients contained in other containers in the dispenser to create a drink for the consumer.

Also provided is a sealing mechanism for sealing each container to preserve the ingredients contained in the container for long periods of time.

It is another object of the present invention to provide a means for detecting the size of a container and accordingly adjusting the amount of ingredient pulled from the container to make a drink in proportion to the volume of the container size.

It is another object of the invention to provide a drink suggestion engine to generate suggested drinks based on a consumer's stored profile, the consumer's taste, concentration, and/or ingredient preference.

It is another object of the invention to select and display a drink selection based on the consumer's history of drink selection stored on a mobile device or taken from a wireless location such as a cloud.

It is another object of the invention to provide a display device to show drink selections available in the dispenser that are created from the ingredients available in the dispenser, wherein the drink selections are selectable by the consumer for consumption.

It is another object of this invention to provide an age verification system where previously stored information regarding the consumer's age or date of birth is provided to the dispenser using a storage/reading device, such as an RFID device, an identification card scanner, near-field communication (NFC) from a phone, or biometric readings of the consumer.

It is also an object of the invention to provide a method for a first dispenser to connect to other dispensers to receive suggested or most selected drink recipes from that other dispenser for use at the first dispenser. This can be accomplished using a wireless communication connection or other data transfer means.

Finally, it is the intent of the invention to utilize a mobile phone application that provides favorite drink recipes from other selected consumers, that provides alerts for low ingredient levels, and provides the capability to perform other administrative tasks.

Still other objects of the present invention will become readily apparent to those skilled in this art from the following description wherein there is shown and described the embodiments of this invention, simply by way of illustration of the best modes suited to carry out the invention. As it will be realized, the invention is capable of other different embodiments and its several details are capable of modifications in various obvious aspects all without departing from the scope of the invention. Accordingly, the drawing and descriptions will be regarded as illustrative in nature and not as restrictive.

BRIEF DESCRIPTION OF THE DRAWINGS

Various exemplary embodiments of this invention will be described in detail, wherein like reference numerals refer to identical or similar components, with reference to the following figures, wherein.

DETAILED DESCRIPTION OF THE EMBODIMENTS

The claimed subject matter is now described with reference to the drawings. In the following description, for purposes of explanation, numerous specific details are set forth in order to provide a thorough understanding of the claimed subject matter. It may be evident, however, that the claimed subject matter may be practiced with or without any combination of these specific details, without departing from the spirit and scope of this invention and the claims.

As used in this application, the terms "component", "module", "system", "interface", or the like are generally intended to refer to a computer-related entity, either hardware, a combination of hardware and software, software, or software in execution. For example, a component may be, but is not limited to being, a process running on a processor, a processor, an object, an executable, a thread of execution, a program, and/or a computer. By way of illustration, both an application running on a controller and the controller can be a component.

Figure 1:
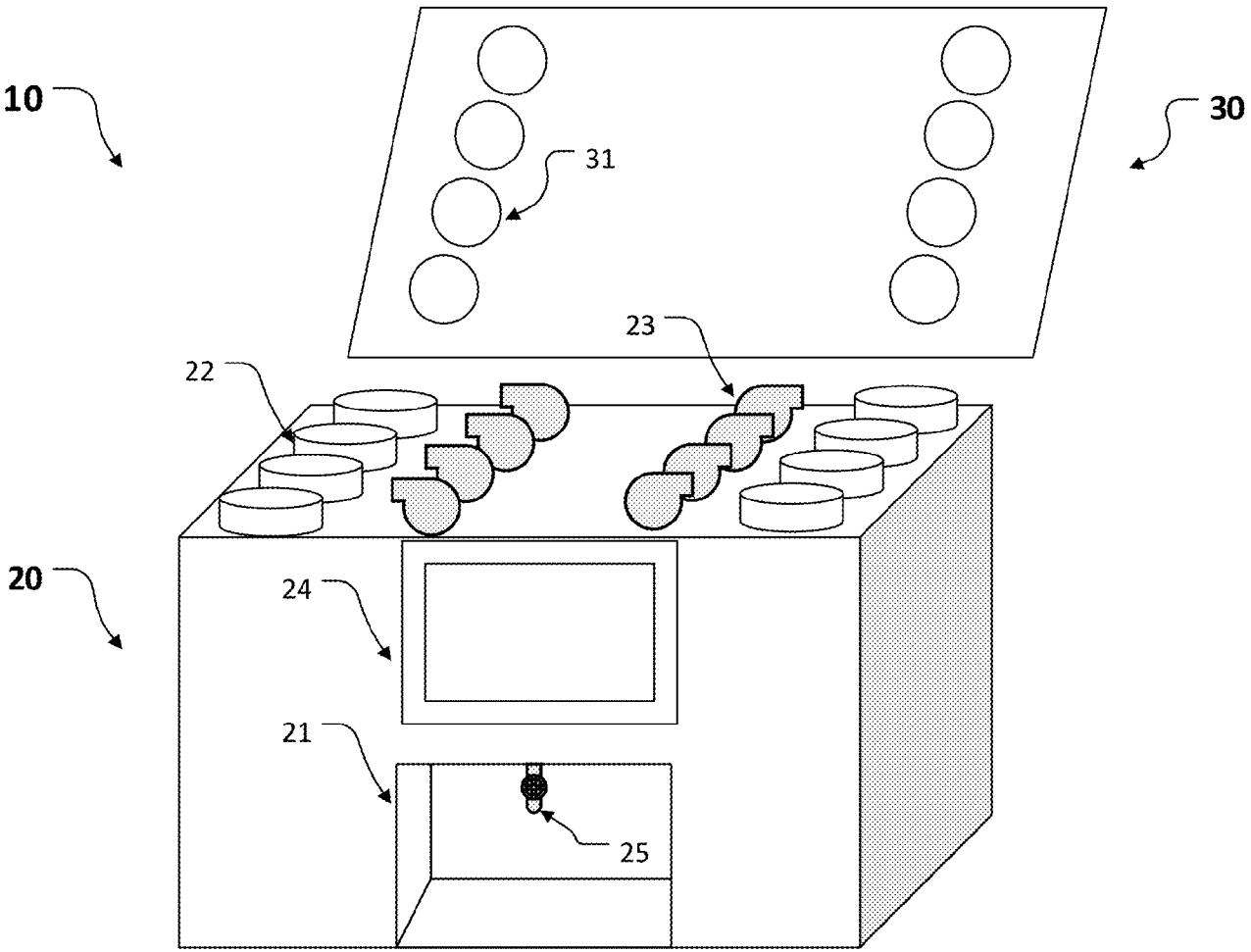
FIG. 1 is perspective view of a drink dispenser according to this invention.

FIG. 1 is a perspective view of a drink dispenser, according to at least some embodiments of this invention. With particular reference to the above-mentioned figures, the dispenser according to the invention is designated as a whole by the reference number 10. In the present example, dispenser 10 is configured to hold eight liquid ingredients in container(s) 22. However, this illustration is only intended as an example and any number of container(s) 22 and corresponding ingredients may be added to the dispenser 10, without departing from the scope of the invention. For convenience, subsequent portions of this description will refer to any combination of those ingredients or any single consumable ingredient collectively as a drink.

The dispenser 10, may be portable in nature and can generally be placed on a table or countertop. The dispenser 10 can be made from any material including polycarbonates, ceramics, metals, or plastics or any other material not yet known which serves the structural purpose necessary to support the device and the internal components.

Various components of dispenser 10 are contained within a housing 20 and a removable top 30. On its front side, housing 20 includes a display/input device 24, a recess 21 and a nozzle 25 located within recess 21. Although not shown in FIG. 1, recess 21 may also include a cup/container sensing device for detecting the presence and approximate size of a cup or container placed in recess 21. Using the presence and approximate volume of the cup placed in the recess 21, the dispenser 10 can use this information to modify the ratio of ingredients added to the cup based on the cup's volume based on the embodiments for dispensing a drink described herein. Dispenser 10 may also include a backsplash and a drain pan assembly. Spillage and drips from nozzle 25 fall through the spaces of a grill (not shown) in a drain pan assembly and are funneled into a drain tube (also not shown) for disposal.

Figure 2:
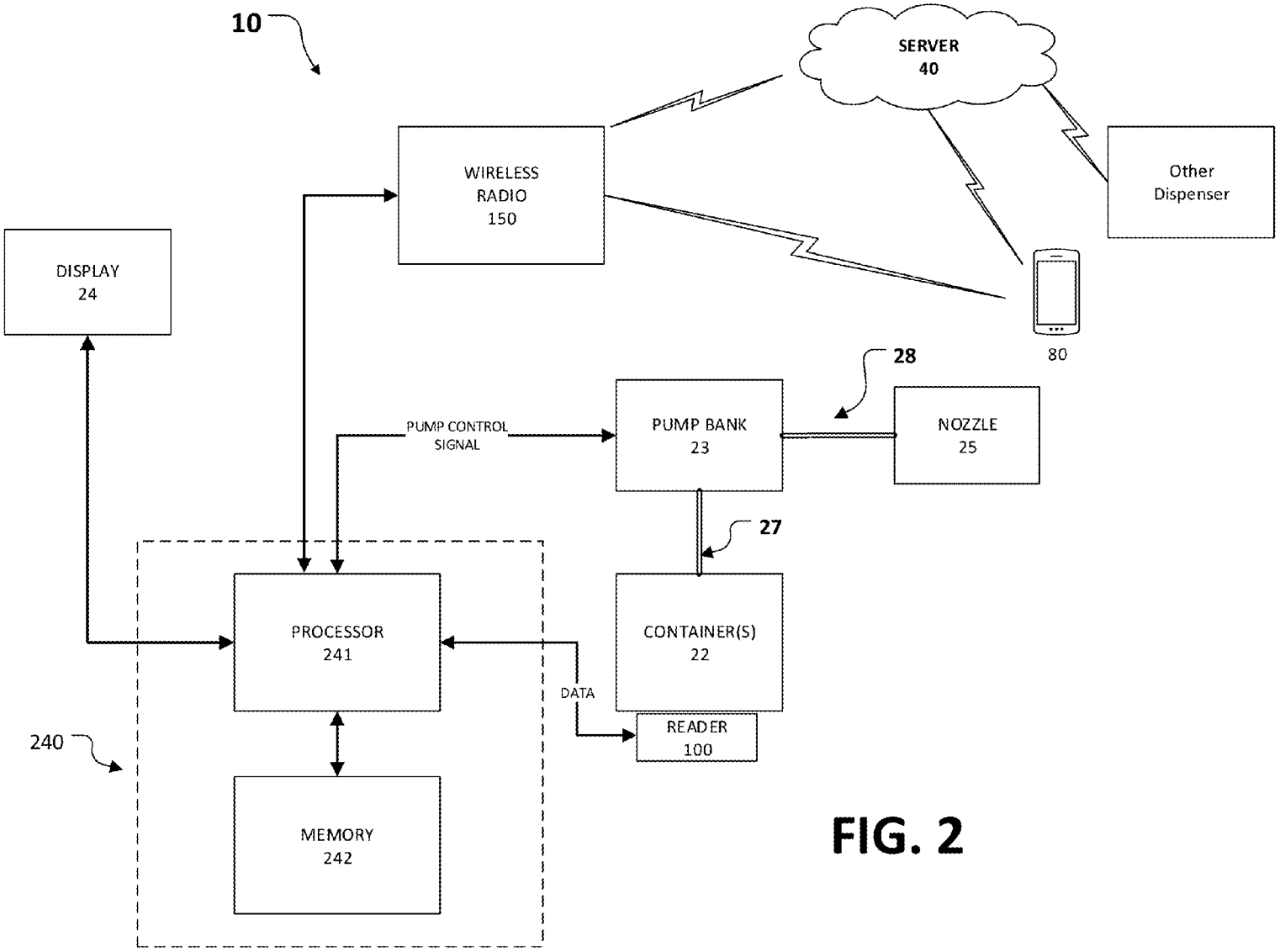
FIG. 2 is a block diagram illustrating the various components of the dispenser according to at least some embodiments of this invention.

The display/input device 24 includes a main display area that can be touch screen or include one or more buttons that a consumer can press to initiate various operations of the dispenser 10. For example, display/input device 24 may have a button that a consumer can actuate to select a drink or to begin drink flow from nozzle 25. As another example, display/input device 24 might include a touch screen interface for performing administrative tasks, such as initial set up or ingredient refilling of dispenser 10. Also, the display/input 24 device may be a voice recognition system wherein the display/input device may be in a listening (voice recognition) mode where based on the consumer's previously recognized voice, an input may be provided to processor 241 (as shown in FIG. 2) for carrying out specific actions, such as ordering a drink.

Generally on the top side of housing 20, dispenser 10 includes a pump bank 23 and the open ends of a number of container(s) 22. Pump bank 23 is made of multiple individual pumps. Each individual pump in pump bank 23 is coupled with each container(s) 22. As used herein, "coupled" includes two elements that are attached directly or by one or more intermediate elements. Each pump in pump bank 23 can include a variable speed peristaltic pump or other type of known pump used for pumping beverage grade liquids at a controllable rate, with pump speed versus flow rate data provided by the pump manufacturer or determined through a calibration test. Container(s) 22 can be made of anything capable of holding consumer grade liquids, including glass, plastic, paper or a bag-in-a-box (BIB).

A controller, which is not shown in FIG. 1 but is discussed below in FIG. 2, stores data indicating how fast each pump in pump bank 23 should pump when dispensing a particular selected drink. In response to a signal from the display 24, and based on its stored data, the controller activates a pump to dispense an ingredient from container(s) 22. For example, assume that a consumer has selected a drink requiring the dispensing of two ingredients from container(s) 22. To make the appropriate resultant mixture in this example, the first ingredient should be dispensed at twice that of the second ingredient (2:1 ratio). Accordingly based on the stored information in the controller, the first ingredient should be pumped at a first speed, and the second ingredient should be pumped at a second speed (different from the first speed) to achieve to achieve the proper mixture. Upon selection by the consumer at display/input device 24 the controller activates the corresponding pump associated with the first ingredient at the first speed upon the appropriate detection and calculation based on the volume of the cup to hold the drink. This results in a flow of the first ingredient out of nozzle 25. Simultaneously, the controller activates the corresponding pump associated with the second ingredient at the second speed. This results in a flow of the second ingredient to nozzle 25. Accordingly, the two ingredients are mixed and dispensed to the cup placed in recess 21. It should be understood that any combination of ingredients from container(s) 22 can be mixed according to this process. While this example requires that the ingredients be dispensed simultaneously, one should recognize that the ingredients may be dispensed sequentially to make the appropriate drink. One may also recognize that pump bank 23 may also include pumps that incrementally dispense ingredients in measured amounts based on the dispensed volume rather than at a particular flow rate, as described above, without departing from the scope of this invention. For example, the ingredient being dispensed may be dispensed in increments of ounces.

Now referring to removable top 30 of dispenser 10, the removable top 30 has on its underside, a sealing mechanism 31. When the removable top 30 is placed on the housing 20, the sealing mechanism 31 intended to be positioned to contact each open end of container(s) 22. The contact between the sealing mechanism 31 and each container(s) 22 is intended to be substantially airtight to prevent contamination, prevent spillage and preserve the integrity of the ingredients contained in each container(s) 22. The sealing mechanism 31 may be a silicone type or other acceptable material now known or later developed, which does not contaminate or alter the general nature of the ingredients in container(s) 22. One of ordinary skill in would recognize that the sealing mechanism 31 can be individual seals that are attached to each container(s) 22, without being attached the removable top 30, without departing from the scope of the invention.

FIG. 2 is a block diagram showing the connection and interaction of the controller 240 and other various components of dispenser 10 according to at least some embodiments of this invention. FIG. 2 also depicts fluid and signal flows between the various components of dispenser 10. Controller 240 includes a processor 241 that executes instructions to carry out operations of controller 240 described herein. Those instructions can be stored as executable instructions and data in a memory 242 and/or may be hardwired logic within processor 241. Memory 242 also stores data, such as drink recipes, as further described below. Although shown as separate blocks in FIG. 2, processor 241 and memory 242 could be implemented as part of a single integrated circuit device.

As explained more fully below, controller 240 is configured to control operations of dispenser 10. Controller 240 communicates instructions to and receives signals from display 24. In a similar manner, controller 240 communicates with and/or supplies power to the wireless radio 150, reader 100 and display 24.

Controller 240 also communicates control signals and/or provides power to each pump of pump bank 23. Each pump of pump bank 23 includes an electric motor and a pumping mechanism. In response to control signals and/or power from controller 240, the motor drives the pumping mechanism so as to pull and dispense ingredients from container(s) 22. In particular, each pump of pump bank 23 is in fluid communication with hose 27. As used herein, "in fluid communication" means that fluid can flow from one named point to another named point. Once container(s) 22 has been filled with an ingredient and hose 27 is inserted into the container(s) 22, a corresponding pump in pump bank 23 can thereby withdraw that ingredient from that container. A second end of hose 27 is attached to a fitting (not shown) of a corresponding pump in pump bank 23. Fluid output from the actuated pump in pump bank 23 flows through a hose 28 to nozzle 25. So as to avoid unnecessary drawing detail, certain conventional components have been omitted from FIG. 2. For example, connections to an external power supply (e.g., to a source of 120V AC power) and components for distributing electrical power to controller 240 and other components of dispenser 1 (e.g., AC/DC converter and power supply, distribution wiring, etc.) are not shown. Also, it should be recognized that the dispenser can be powered by other power devices without departing from the scope of the invention, such as rechargeable batteries.

Each container(s) 22 has an associated reader 100 in communication with it. Reader 100 is a fluid level sensor. Numerous commercially developed types of fluid level sensors and associated electronics are known in the art and thus not further described here. Other embodiments may employ different types of known and commercially available data reading devices to identify ingredients in container(s) 22, including but not limited to RFID (radio frequency ID) readers, bar code scanners, OCR (optical character recognition) scanners, etc. Reader 100 periodically sends data updates to processor 241 indicating the measured ingredient level in each container(s) 22. Using that measured ingredient level, processor 241 then stores that data in memory 242 and initiates actions if the ingredient level is below a certain thresh hold. For example, processor 241 can initiate commands to send a text message to the owner of the dispenser 10 alerting him that ingredient levels are low.

As discussed above, processor 241 also determines the appropriate rate at which pump 23 must be operated so as to mix the ingredients in the correct ratio. The determined mixing parameters can then be stored in memory 242.

In operation, as a consumer inputs a drink selection at display 24, processor 241 receives a dispense signal. In response to the dispense signal, processor 241 accesses the data previously stored and associated with the dispense signal in memory 242 and activates components of pump bank 23, in accordance with that data. For example, if the consumer were to make a drink selection that calls for ingredients to be dispensed from two separate container(s) 22, the dispense signal would initiate that selection and according to the stored data associated with those signals, the processor 241 would send the appropriate pump control signals to pump bank 23 to dispense the ingredients from those containers. This action can be performed for a single container(s) 22 or for multiple container(s) 22. This may also be performed in any sequence based on the dispense signal.

Also shown in FIG. 2 is a wireless radio 150, in direct communication with a server 40 and a mobile device 80, according to this invention. The wireless radio 150 wirelessly transfers and receives instructions, commands and data from the server 40 and/or the mobile device 80 for use by processor 241.

The server 40 also contains at least one processor for carrying out their server's specific functions and commands related to the functions performed by the server 40. In the next subsequent few paragraphs, examples of some of the functions that may be carried out by each server will be illustrated for contextual purposes. However, one of ordinary skill in the art will recognize that other functions and commands may be carried out in each server without departing from the scope of this invention.

According to the embodiments of this invention, the server 40 contains at least a drink suggestion engine function, a mobile application function, a dispenser function and an administration (admin) function. These functions may be performed by separate dedicated processors or they may be performed by a single set of instructions contained in a single processor. In general, server 40 initiates, executes, stores, sends and retrieves commands and data related to these functions to and from the mobile device 80, the wireless radio 150 and other connected dispensers, as shown in FIG. 2.

Drink Suggestion Engine Function

The drink suggestion engine function's purpose is to provide a consumer with a listing of drinks suggested based on a previously stored, newly created profile or previously stored data in dispenser 10. More particularly, the drink suggestion function uses previously stored data to provide a listing of drinks to the consumer that are based on ingredients or other drink characteristics stored in container(s) 22 that are the same or similar to drinks either stored in the consumer profile or recently ordered from the dispenser 10. In the case of using a consumer profile, upon the input of a consumer profile at display 24, the processor 241 communicates with the server 40 to retrieve drink suggestions from the data stored in the server 40 based on the same or similar ingredients or characteristics. For example, if a consumer has traditionally ordered drinks with cranberry juice as one ingredient and that ingredient is currently in container(s) 22, the processor 241 will retrieve drink recipes from the server 40 that are cranberry juice based and present those in a listing to the consumer for selection. Also, instead of using a particular ingredient from previously ordered drinks, the drink suggestion engine may suggest drinks based on other characteristics that have been previously tagged by the consumer or previously stored by a system administrator. This may include suggesting drinks based on taste preference from user such as strong, sweet, sour, etc. It should be understood that while this exemplary embodiment describes the drink suggestion engine as being a part of the server 40, it should be understood from one of ordinary skill in the art that the drink suggestion engine may be local to the dispenser 10 or in the mobile application, without departing from the scope of this invention.

In the case of using data from the dispenser 10, the consumer may select an input from display 24 asking for the most popular drinks ordered from dispenser 10. These suggested drinks will also be based on the current ingredients contained in container(s) 22. Upon processing of this information by the processor 241, the dispenser 10 will interact with server 40 to retrieve and display a listing of drinks based on this selection and data. Going forward, both listings of drinks (profile based and dispenser based) will commonly be referred to as "suggested drinks".

Mobile Application Function

The mobile application function's purpose, among other things, is to manage and initiate commands related to communications to and from mobile device 80. Mobile device 80 may communicate with the dispenser 10 directly or via the wireless radio 150 or via routing through server 40 to dispenser 10. The server 40 further may be in communication with one or more databases, that store drink selections and various items of data (application data) related to providing suggested drinks or drink recipes to users of mobile device 80, as well as storing and using consumer profiles. Such consumer profile data may include a mobile device user profile or profiles of other consumers that are downloadable by mobile device 80, and metadata related to the application files that allow users of mobile device 80 to catalog consumer profiles stored on the mobile device 80. The application metadata also may include information regarding the cost of drinks, any promotional pricing changes or the like to be applied to a particular dispenser 10, information regarding the geographic markets and end-user language for which the server 40 may retrieve data from, editorial content such as media and consumer reviews of a drink selection, any mobile operator-specific business policies that are to be applied to the purchase of a drink, and any other suitable type of metadata related to drink selections and suggested drinks stored in the server 40.

For illustrative purposes, a consumer may input their favorite drink selections or suggested drinks in a mobile application resident on mobile device 80. Communicating through the wireless radio 150, the processor 241 may connect to server 40 and retrieve the drink recipe or the consumer may push the recipe down to dispenser 10 using the same bidirectional communication. Alternatively, the mobile device user may wish to provide or "tag" their suggested drinks on the server 40 for use in providing suggested drink listings, as described above.

The server 40 also may also store consumer profile data, which can be input from the mobile device 80 by a user. The consumer profile data may include data related to individual consumers, including but not limited to a consumer's identity, account number, credit card/debit card/other preferred payment mechanism, type of mobile device used by each consumer, geographic location of each consumer, language preferences of each consumer, etc.

Administrative Function

Continuing with FIG. 2, a remote owner of dispenser 10 may be able to interact with the dispenser 10 using a remote connection into dispenser 10 using the administration functions of server 40. In general, the administrative function is provided to allow owners or designated administrators of dispenser 10 to provide updates to the firmware of dispensers, receive and act on alerts from their dispenser 10—such as ingredient levels, and retrieve other data, such as frequency of orders of a particular drink from dispenser 10 or other information such as how much money a dispenser 10 has collected in a given time period.

The administration function may also allow a consumer to submit/store new drink selections for inclusion in the suggested drink listings of server 40, to submit updates and new versions to the mobile application used by mobile device 80, to push promotions for drinks, to modify pricing, business rules, and other information related a dispenser 10, and to take any other suitable action related to interactions submitted using mobile device 80 and/or configured to be operated on other dispensers that access the server 40. The server 40 also contains a processor for carrying out functions, such as determining what function (administration, application or dispenser) an incoming command relates to and thus routing the command to the appropriate function for execution or storage. For example, the administration function can parse profile updates and suggested drink data being sent from a mobile device consumer so that it can be stored in the appropriate locations of data servers of server 40.

Dispenser Function

The server 40 may also contain a dispenser function where various processes related to other connected dispensers can be carried out. In general, the dispenser function is provided to provide a means for dispenser 10 to remotely communicate with another dispenser connected to server 40. For example, in some instances an owner may own multiple dispensers 10 and would like to provide drink selection data from dispenser 10 to the other dispensers owned by the consumer. The dispenser function identifies and stores data related to each of the owner's dispensers such that the other owned dispensers can be identified and communicated with. This can be in the form of a unique identifier of each dispenser, profile and/or location data of each dispenser. Additionally, using the administration function, as described above, a consumer may update the appropriate firmware of all owned dispensers simultaneously. Lastly, a consumer having a mobile application resident on a mobile device 80 may be able to retrieve ingredient level information from all dispensers that he/she owns.

Additionally, for example an owner of dispenser 10 may want to provide drink recipes to another dispenser connected server 40, but not owned by that particular owner. For example, if an owner's friend has a dispenser connected to server 40, and that owner has authorization to provide or retrieve suggested drinks directly to the friend's dispenser, the owner may initiate that process at dispenser 10 to identify the profile and authentication of the friend's dispenser and push or retrieve suggested drinks to the friend's dispenser. The processor 241 may initiate operations input by the consumer at display 24 to connect to the other dispenser and retrieve and display a listing of drinks from the other dispenser. From there, the consumer may select a drink and then be prompted by processor 241 on how to setup their dispenser to make the same drink.

FIGS. 3-6 illustrate methods for performing operations associated with setup of the dispenser, ordering from a dispenser and various methods for providing drink suggestions to a consumer according to the embodiments of this invention. The operations presented below are intended to be illustrative. In some embodiments, the methods may be accomplished with one or more additional operations not described, and/or without one or more of the operations discussed. Additionally, the order in which the operations are illustrated in FIGS. 3-6 and described below is not intended to be limiting.

In some embodiments, the methods may be implemented in one or more processing devices (e.g., a digital processor, an analog processor, a digital circuit designed to process information, an analog circuit designed to process information, a state machine, and/or other mechanisms for electronically processing information). The one or more processing devices may include one or more devices executing some or all of the operations of the methods in response to instructions stored electronically on an electronic storage medium, such as memory 242 shown in FIG. 2. The one or more processing devices may include one or more devices configured through hardware, firmware, and/or software to be specifically designed for execution of one or more of the operations of the methods.

Figure 3:
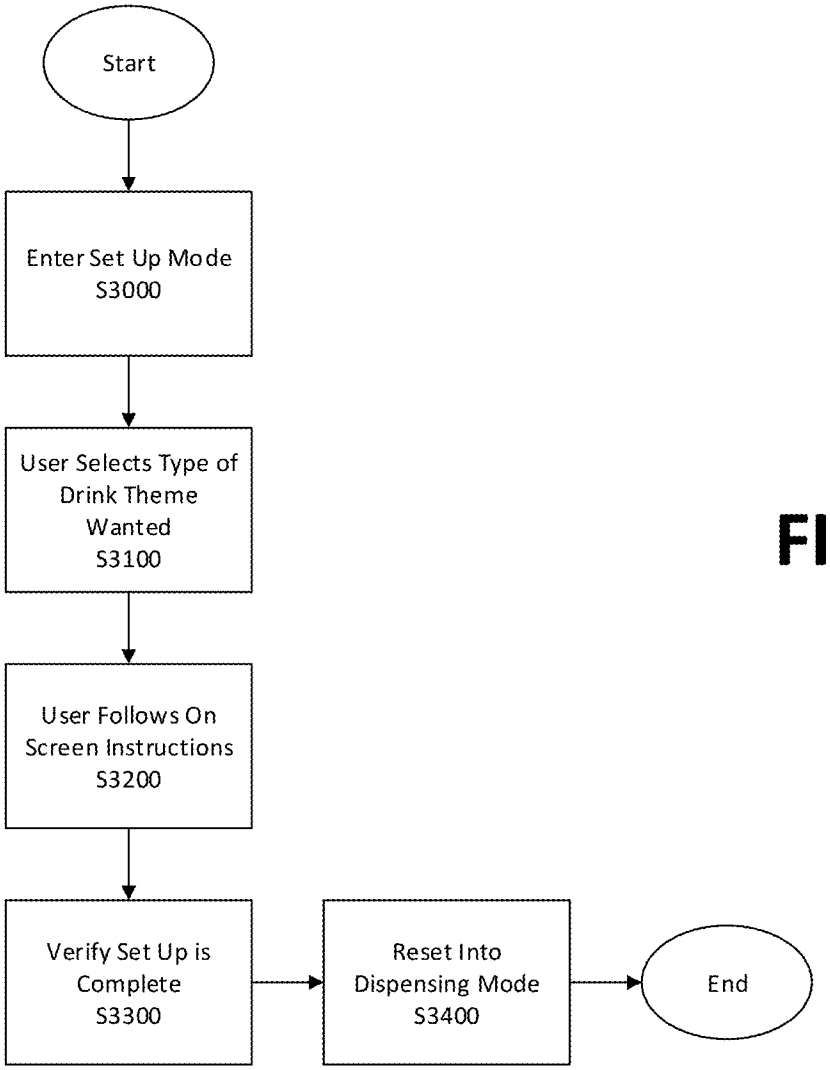
FIG. 3 is a flow chart depicting the preparation and setup of the dispenser according to some embodiments of this invention.

FIG. 3 illustrates a method for the set up and refilling of containers according to the embodiments of this invention. Upon receipt of a start command, the process begins at operation S3000. The start command can be the selection of the set up mode from a series of administrative functions capable of being performed by the dispenser or downloaded from a server. At operation S3000, a processor executes commands to place the dispenser in a set up mode. In the set up mode, a processor disables the ability of the dispenser to make drinks, thereby disabling dispensing components and pumps of the dispenser. However, prior to full disablement of the pumps, the pumps and hoses may be purged to remove any unnecessary ingredients left in them. Upon completion of these steps, the setup mode is completed by the processor displaying drink themes to the consumer. Operation S3000 may be performed by a controller that is the same as or similar to the controller depicted in FIG. 2, in accordance with one or more implementations. The method then moves to operation S3100.

At operation S3100, the consumer is prompted to select from a series of preprogrammed drink themes stored in a memory. This selection of drink theme begins the instructions for filling the dispenser and allows the consumer to select a drink configuration for the dispenser. For example, the drink themes can be based on a basic set up, a themed setup or brand specific set up. In this example, the basic set up could be based on drinks made from traditional alcohol based drink ingredients, such as vodka, rum, whiskey, gin, cola, water, orange juice and tonic. The themed selections could be based on a selection among geographic areas (Hawaiian, Caribbean, etc.), where the ingredients requested by the dispenser at operation S3200 will be those ingredients that traditionally make up drinks from a particular region. Also, the drink theme presented to the consumer may be based on a brand of drink. For example, the processor may be preprogrammed with drinks based on Bacardi™ brand ingredients. Operation S3200 may be performed by a controller that is the same as or similar to controller 240 shown in FIG. 2, in accordance with one or more implementations. The method then moves to operation S3200.

At operation S3200, a processor then causes a display to show a series of instructions to the consumer to fill each container with a particular ingredient, based on the drink themes selected by the consumer at operation S3100. Unlike other methods discussed below, because the processor is presenting the instructions to the consumer there is no need write data to the memory indicating what ingredient has been placed in each container. In this operation, the consumer simply needs to follow the preprogrammed on screen instructions. For example, an instruction can be that orange juice needs to be placed in the first container and cola should be placed in the third container. The instructions will continue until each container is filled or until all ingredients for the selection have been added. The method then continues to operation S3300.

At S3300, the consumer verifies that the instruction steps have been completed. The operation moves to S3400, where the processor resets the dispenser by priming the pumps and places it into dispense mode and ends.

Figure 4:
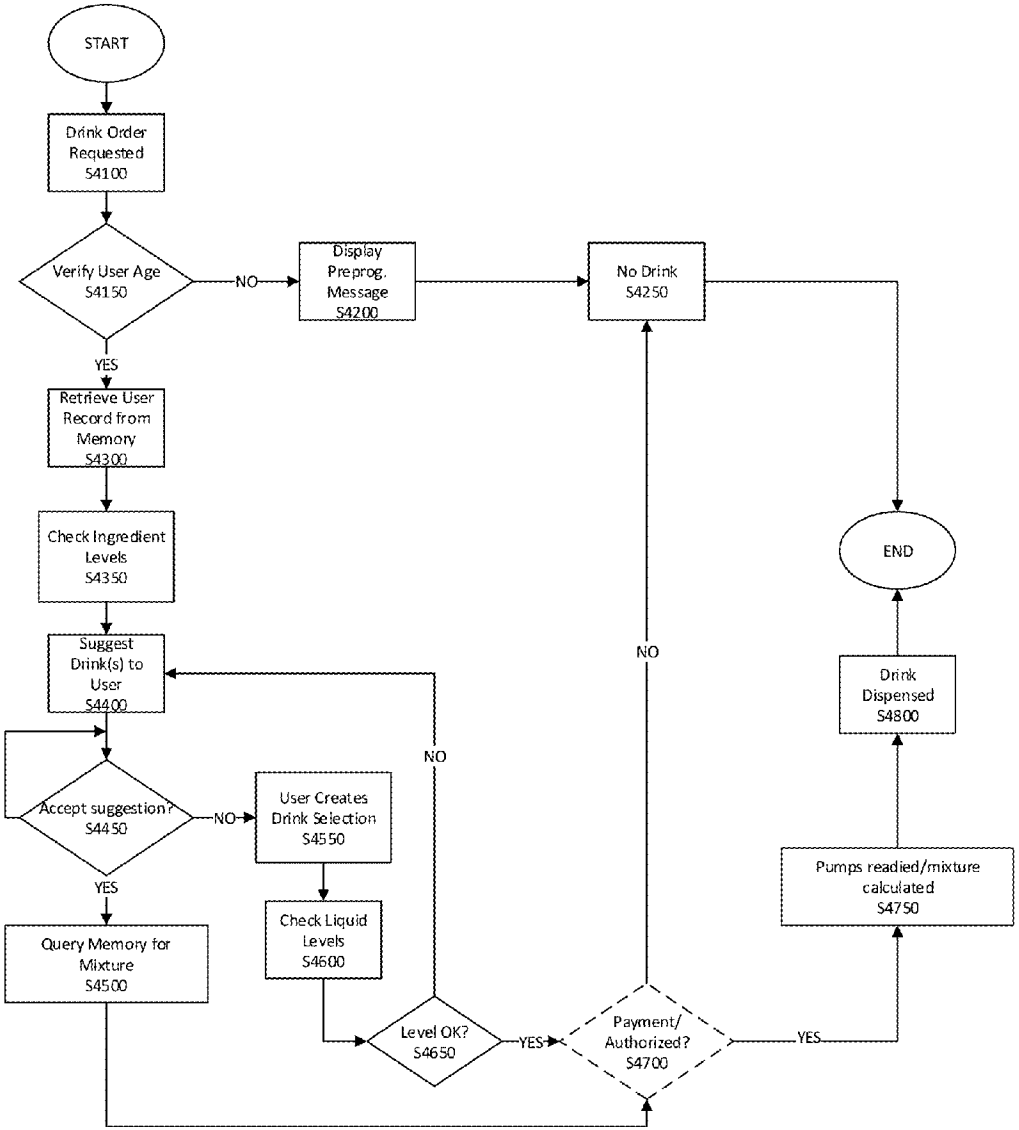
FIG. 4 is a flow chart depicting steps of ordering a drink from the dispenser according to some embodiments this invention.

FIG. 4 illustrates a method wherein the dispenser provides a drink suggestion to a consumer based on a consumer's age and/or previously stored drink profile. Upon receipt of a start command, the process begins at operation S4100. At operation S4100, the consumer who wishes to order drink can select an icon on the display to order a drink. The process then moves to operation S4150.

At operation S4150, if necessary, the processor then may initiate an age verification process to ensure that the consumer is of an age suitable to purchase beverages from the dispenser. Execution of this operation may be made dependent on the set up previously initiated in the set up process, as illustrated in FIG. 3. For example, during the setup of the dispenser, the processor may prompt the consumer to indicate which container has ingredients containing alcohol. If a subsequent drink is ordered that contains ingredients from one of the containers previously indicated as having alcohol, the processor may request that the consumer verify their age. This age verification may be performed by a storage/reading device, such as an RFID device, an identification card scanner, near-field communication (NFC) from a phone, or biometric readings of the consumer. If the age of the consumer is not verified, the process moves to operation S4200; otherwise, the process moves to operation S4300. This age verification process may also, or alternatively, be performed after a consumer has selected a drink, for example after operation S4450, as described below.

At operation S4200, a preprogrammed message is displayed indicating that the age verification was not complete, no drink is dispensed at S4250 and then the process ends.

At operation S4300, where the consumer's age has been verified, the processor may retrieve a consumer record from memory to determine if the consumer has a favorite drink(s) or a drink that they have previously stored as a drink that they would like to try. If the consumer does not have a previously stored consumer profile, the process automatically moves to operation S4350, where the ingredient levels in the containers are read by a liquid level reader and provided to the processor to determine which drinks will be suggested to the consumer at operation S4400.

If a consumer's profile is available, once the ingredient levels have been checked for availability, the processor retrieves and displays drinks that can be made from the ingredient levels available in the containers that are the same or similar to drinks in the consumer's profile. If there is not an available consumer profile, the processor will create suggested drinks from the available ingredients in the containers based on drink recipes previously stored in the dispenser or based on a listing of suggested drinks retrieved from a server. Additionally, characteristics such as the strength of drink, the most ordered drink or drinks suggested from a consumer through a mobile phone application may be used by the processor to determine suggested drinks to display. The process then moves to S4400 where the suggested drinks are displayed to the consumer.

At this point, the consumer may either select one of the suggested drinks, in which the memory will be cued for the selected drink; or the consumer may not select any of the suggested drinks and create their own drink selection. The process moves to operation S4450 where the processor goes into a loop and waits on the consumer to select one of the suggested drinks or decide to make their own selection. If the consumer selects one of the suggested drinks, the process moves to S4500; otherwise, if the consumer indicates that the selected drinks are not wanted, the process moves to operation S4550.

At operation S4550, the consumer may choose to create their own drink based on the ingredients already contained in the dispenser. Here, the consumer can select each ingredient to be mixed and dispensed for consumption. This is achieved by inputting a series of selections on the display indicating how many units of each ingredient the consumer wants dispensed. For example, the consumer may select two units of cola and one unit of rum to be dispensed, if they are available in the container and the ingredient levels are adequate. Upon completion of the selections, the process moves to operation S4600 and then to S4650 where the processor queries a liquid level reader to ensure that the selected ingredient units are present in the dispenser. As in this example, if the two units of cola are not available in the containers, the selected drink cannot be dispensed. Therefore the process returns to operation S4400 where the processor would perform operations to suggest drinks to the consumer based on the ingredient levels available in the dispenser; otherwise the process moves to S4700 where a payment for the selected drink may be requested.

Returning now to operation S4500, where the consumer has accepted the suggested drink, the processor will query the memory for the correct recipe of the selected drink. The process then moves to operation S4700, where a payment is requested and authorized. Should a payment not be needed, the process moves past operation S4700 and then moves to operation S4750.

At operation S4750, the pumps attached to the containers with the selected ingredients are readied and the process may then initiate a process to determine the size of the cup and recalculate the recipe to fill a larger cup. For example, the dispenser may initially calculate a recipe for a 10 oz. drink. Should the consumer put an 18 oz cup in the recess, the processor will recalculate the recipe to dispense an 18 oz drink, rather than a 10 oz drink. The drink is then dispensed at operation S4800 and the process ends.

Figure 5:
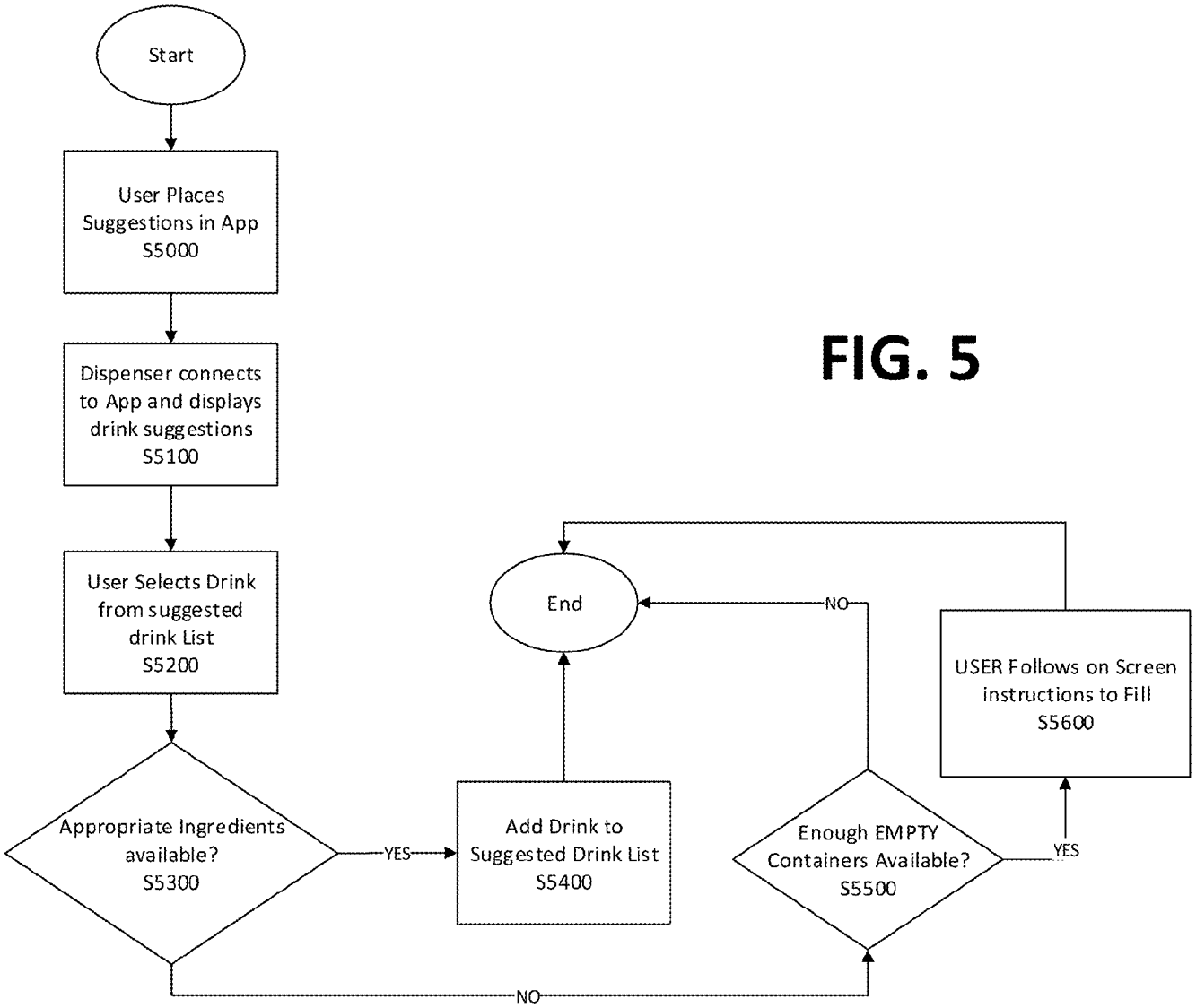
FIG. 5 is a flow chart depicting a method for receiving a drink suggestion from a wireless application according to some embodiments this invention.
Figure 6:
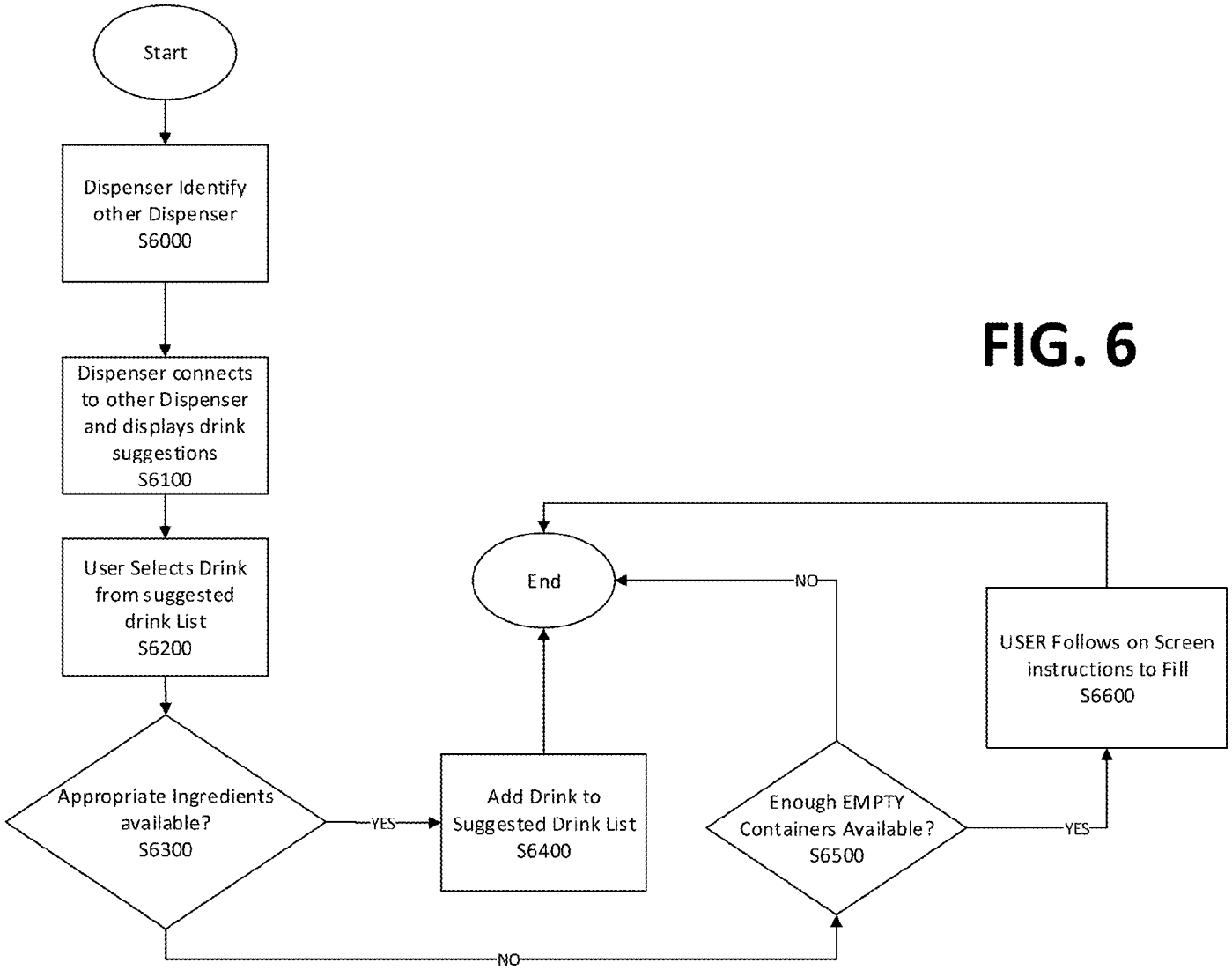
FIG. 6 is a flow chart depicting a method for accessing drink recipes from other dispensers according to some embodiments this invention.

FIGS. 5 and 6 illustrate the processes of receiving drink suggestions from a mobile phone application and other similar dispensers according to the embodiments of this invention. Both processes are similar in that once the drink selection has been received and stored, the processes operate the same.

The process in FIG. 5 begins at operation S5000. There, a consumer can mark a particularly favorite drink and identify it as a drink that is recommended or suggested by that consumer. The identification process changes a drink suggestion setting in the application to indicate that the drink has been recommended or suggested by the consumer. Upon identification, the consumer's suggested drinks are stored locally in a memory of the processing device being used—e.g. a mobile phone, computer or a server, and are synchronized with the identification of the consumer found in another external application on a remote server. Periodically, the application can communicate with the remote server providing the consumer's suggested drinks for storage and retrieval by a connected dispenser. The process then moves to operation S5100.

At operation S5100, the dispenser connects to a server to retrieve suggested drinks from the consumer. Upon the processor initiating a command to retrieve the identified suggested drinks, the consumer's identification and drink suggestions are communicated over a communication network from the remote server connected to the dispenser. The dispenser then stores the suggested drinks in a suggested drink list in its memory for use and display to the consumer. The process then moves to operation S5200.

At operation S5200, the consumer selects a drink from the suggested drink list. This selection can be any method, such as interaction with a graphical user interface (GUI). From there, the process moves to S5300, where the processor queries a liquid level reader to ensure that the needed ingredients are present in the dispenser. If so, the processor moves to operation S5400 where the drink is added to the suggested drink list and output to the display. If not, the process moves to operation S5500 to see if there are enough empty containers available to add the necessary ingredients. If there are enough empty containers. The process moves to operation S5600 where the consumer follows on screen instructions to fill the containers with the ingredients needed for the suggested drink. Then the process ends.

FIG. 6 illustrates the use of suggested drinks from a first dispenser on a second dispenser that is identified to the first dispenser. The process begins at operation S6000. There, a consumer can mark a particularly favorite drink and identify it as a drink that is recommended or suggested by that consumer. The identification process changes a drink suggestion setting in the dispenser to indicate that the drink has been recommended or suggested by the consumer. Upon identification, the consumer's suggested drinks are stored locally in a memory of the first dispenser. When wanted, the first dispenser can initiate commands to remotely connect to a server where the second dispenser has been identified. This is completed at operation S6100.

At operation S6100, the dispenser connects to a wireless communication network to retrieve suggested drinks from the consumer. Upon the processor initiating a command to retrieve the identified suggested drinks, the consumer's identification and drink suggestions are communicated over the communication network from the remote server connected to the dispenser. The dispenser then stores the suggested drinks in a suggested drink list in its memory for use and display to the consumer. The process then moves to operation S6200.

At operation S6200, the consumer selects a drink from the suggested drink list. This selection can be any method, such as interaction with a graphical user interface (GUI). From there, the process moves to S6300, where the processor queries a liquid level reader to ensure that the needed ingredients are present in the dispenser. If so, the processor moves to operation S6400 where the drink is added to the suggested drink list and output to the display. If not, the process moves to operation S6500 to see if there are enough empty containers available to add the necessary ingredients. If there are enough empty containers. The process moves to operation S6600 where the consumer follows on screen instructions to fill the containers with the ingredients needed for the suggested drink. Then the process ends.

What has been described above includes examples of the claimed subject matter. It is, of course, not possible to describe every conceivable combination of components or methodologies for purposes of describing the claimed subject matter, but one of ordinary skill in the art can recognize that many further combinations and permutations of such matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

The invention claimed is:

1. A system for dispensing drinks to a consumer comprising:

a) a device for preparing and dispensing ingredients comprising:

at least one container for holding ingredients;

at least one pump connected to the at least one container to facilitate dispensing of the ingredients from the at least one container;

a first processor for receiving an input from the consumer, and actuating the at least one pump for dispensing a drink selection of the consumer; and a memory for:

storing data based on which ingredient is contained in the at least one container, and is associated with the at least one pump; and storing data based on dispensing units associated with each drink selection; and (b) a remote server in communication with the device for preparing and dispensing ingredients for consumption, wherein the server comprises:

a memory; and a second processor, wherein the second processor contains at least:

an administration function, wherein the administration function retrieves information from the first processor relating to characteristics of the dispenser;

a dispenser function;

a mobile device application function; and a drink suggestion function, wherein the drink suggestion function causes the second processor to compare previously stored data indicative of a drink ordering history and selects at least one characteristic from the previously stored data and compares the characteristic to previously stored suggested drinks in the remote server; and upon matching the characteristic in the suggested drinks and drink ordering history, the second processor causes the first processor to display the suggested drinks matching the characteristic to the consumer on a display on the device.

2. The system of claim 1, wherein the characteristics of the dispenser can be any one of:

current ingredient levels in the at least one container;

analysis of when drinks are ordered and how often, the current version of the firmware running on the processor; or historical data relating to drinks selected from the device.

3. The system of claim 1, wherein the administration function receives and stores input from the consumer providing recipes of suggested drinks for storage and use in the drink suggestion function.

4. The system of claim 3, wherein the input from the consumer can be provided from an application on a mobile device.

5. The system of claim 1, further comprising an age verification system, wherein the age of the consumer can be verified, wherein the first or second processor can retrieve and verify the consumer's age data from any one of:

a) a preprogrammed RFID device;

b) a driver's license scanner;

c) near-field communication (NFC) from phone; or d) biometric readings of the consumer.

6. The system of claim 1, wherein the at least one pump comprises two or more pumps and each of the two or more pumps is configured to pump a different ingredient.

7. The system of claim 6, wherein the first processor is configured to actuate each of the two or more pumps at different speeds.

8. The system of claim 7, wherein the different speeds are determined to achieve a desired ratio of ingredients in the dispensed drink selection.

9. A system for dispensing drinks to a consumer comprising:

a) a device for preparing and dispensing ingredients comprising:

at least one container for holding ingredients;

two or more pumps connected to the at least one container to facilitate dispensing of the ingredients from the at least one container, wherein each of the two or more pumps is configured to pump a different ingredient;

a first processor configured to receive an input from the consumer, and to actuate each of the two or more pumps at different speeds for dispensing a drink selection of the consumer, wherein the different speeds are determined to achieve a desired ratio of ingredients in the dispensed drink selection; and a memory for:

storing data based on which ingredient is contained in the at least one container, and is associated with the two or more pumps; and storing data based on dispensing units associated with each drink selection; and (b) a remote server in communication with the device for preparing and dispensing ingredients for consumption, wherein the server comprises:

a memory; and a second processor, wherein the second processor contains at least:

an administration function;

a dispenser function;

a mobile device application function; and a drink suggestion function.

10. The system of claim 9, wherein the administration function retrieves information from the first processor relating to the characteristics of the dispenser.

11. The system of claim 10, wherein the characteristics of the dispenser comprise one or more of:

current ingredient levels in the at least one container;

analysis of when drinks are ordered and how often, the current version of the firmware running on the processor; or historical data relating to drinks selected from the device.

12. The system of claim 9, wherein the administration function receives and stores input from the consumer providing recipes of suggested drinks for storage and use in the drink suggestion function.

13. The system of claim 12, wherein the input from the consumer can be provided from an application on a mobile device.

14. The system of claim 10, wherein the drink suggestion function causes the second processor to compare previously stored data indicative of a drink ordering history and selects at least one characteristic from the previously stored data and compares the characteristic to previously stored suggested drinks in the remote server; and upon matching the characteristic in the suggested drinks and drink ordering history, the second processor causes the first processor to display the suggested drinks matching the characteristic to the consumer on a display on the device.

15. The system of claim 9, further comprising an age verification system, wherein the age of the consumer can be verified, wherein the first or second processor can retrieve and verify the consumer's age data from any one of:

a) a preprogrammed RFID device;

b) a driver's license scanner;

c) near-field communication (NFC) from phone; or d) biometric readings of the consumer.

* * * * *